US008303130B2

(12) United States Patent
Sayers et al.

(10) Patent No.: US 8,303,130 B2
(45) Date of Patent: Nov. 6, 2012

(54) MODULAR OPTICAL SYSTEM FOR USE WITH LIGHT EMITTING DIODES IN AT LEAST A WALL WASH CONFIGURATION

(75) Inventors: Wilston Nigel Christopher Sayers, Atlanta, GA (US); Ronald Garrison Holder, Laguna Niguel, CA (US)

(73) Assignee: Cooper Technologies Company, Houston, TX (US)

( * ) Notice: Subject to any disclaimer, the term of this patent is extended or adjusted under 35 U.S.C. 154(b) by 152 days.

(21) Appl. No.: 12/898,054

(22) Filed: Oct. 5, 2010

(65) Prior Publication Data

US 2012/0081896 A1 Apr. 5, 2012

(51) Int. Cl.
*F21S 8/00* (2006.01)

(52) U.S. Cl. ..... 362/147; 362/249.02; 362/311.02; 362/800

(58) Field of Classification Search ..... 362/145, 362/147–153.1, 249.02, 311.02, 800
See application file for complete search history.

(56) References Cited

U.S. PATENT DOCUMENTS

| | | | | |
|---|---|---|---|---|
| 6,986,593 | B2 | 1/2006 | Rhoads et al. | 362/308 |
| 7,114,832 | B2 | 10/2006 | Holder et al. | 362/308 |
| 7,543,941 | B2 | 6/2009 | Holder et al. | 353/43 |
| 7,748,872 | B2 | 7/2010 | Holder et al. | 362/308 |

*Primary Examiner* — Jason M Han
(74) *Attorney, Agent, or Firm* — King & Spalding LLP

(57) ABSTRACT

An optical wall wash system including at least one module comprised of a 2 by 2 array of fixed elements, each element including a reflector and a refractor; a fixture, including light emitting diodes (LEDs) affixed thereto, for securing the at least one module, wherein there is a 1:1 correspondence between elements and LEDs and the fixture is rotated a first angular amount from nadir and towards a wall. Each of the elements within the at least one module is further oriented a different angular amount in relation to its underlying LED from each other element within the at least one module.

18 Claims, 12 Drawing Sheets

MODULAR OPTICAL SYSTEM FOR USE WITH LIGHT EMITTING DIODES IN AT LEAST A WALL WASH CONFIGURATION

BACKGROUND OF THE INVENTION

1. Field of the Invention

The present embodiments relate generally to optical systems for providing wall wash and other light distributions. More particularly, the embodiments described herein are directed to modular light distribution systems including interchangeable optics formed of elements including specific reflector and refractor combinations.

2. Description of the Related Art

Existing wall wash and related type light distribution systems typically utilize high wattage sources and a large, smooth, asymmetric reflector with a diffused lens. These high wattage sources are inefficient.

There is a need in the art for a low power, efficient, modular system that creates a smooth wall wash pattern.

SUMMARY OF THE INVENTION

In a first embodiment, an optical wall wash system includes: at least one module comprised of a 2 by 2 array of fixed elements, each element including a reflector and a refractor; a fixture, including light emitting diodes (LEDs) affixed thereto, for securing the at least one module, wherein there is a 1:1 correspondence between elements and LEDs and the fixture is rotated a first angular amount from nadir and towards a wall; and further wherein each of the elements within the at least one module is oriented a different angular amount in relation to its underlying LED from each other element within the at least one module.

In a second embodiment, a method for forming a module for use in a wall wash system includes: forming a first molded component including four refractors; forming a second molded component including four reflectors, wherein the four reflectors are asymmetrical in orientation with respect to each other; and further wherein one of the first or second molded components is molded so as to include at least one slot and the other of the first or second molded components is molded so as to include at least one pin, such that the first and second molded components are attached using a pin in slot configuration to form the module.

BRIEF DESCRIPTION OF THE FIGURES

The Figures are intended to be exemplary and to be considered in conjunction with the written disclosure herein.

DETAILED DESCRIPTION OF THE INVENTION

Figure 1:
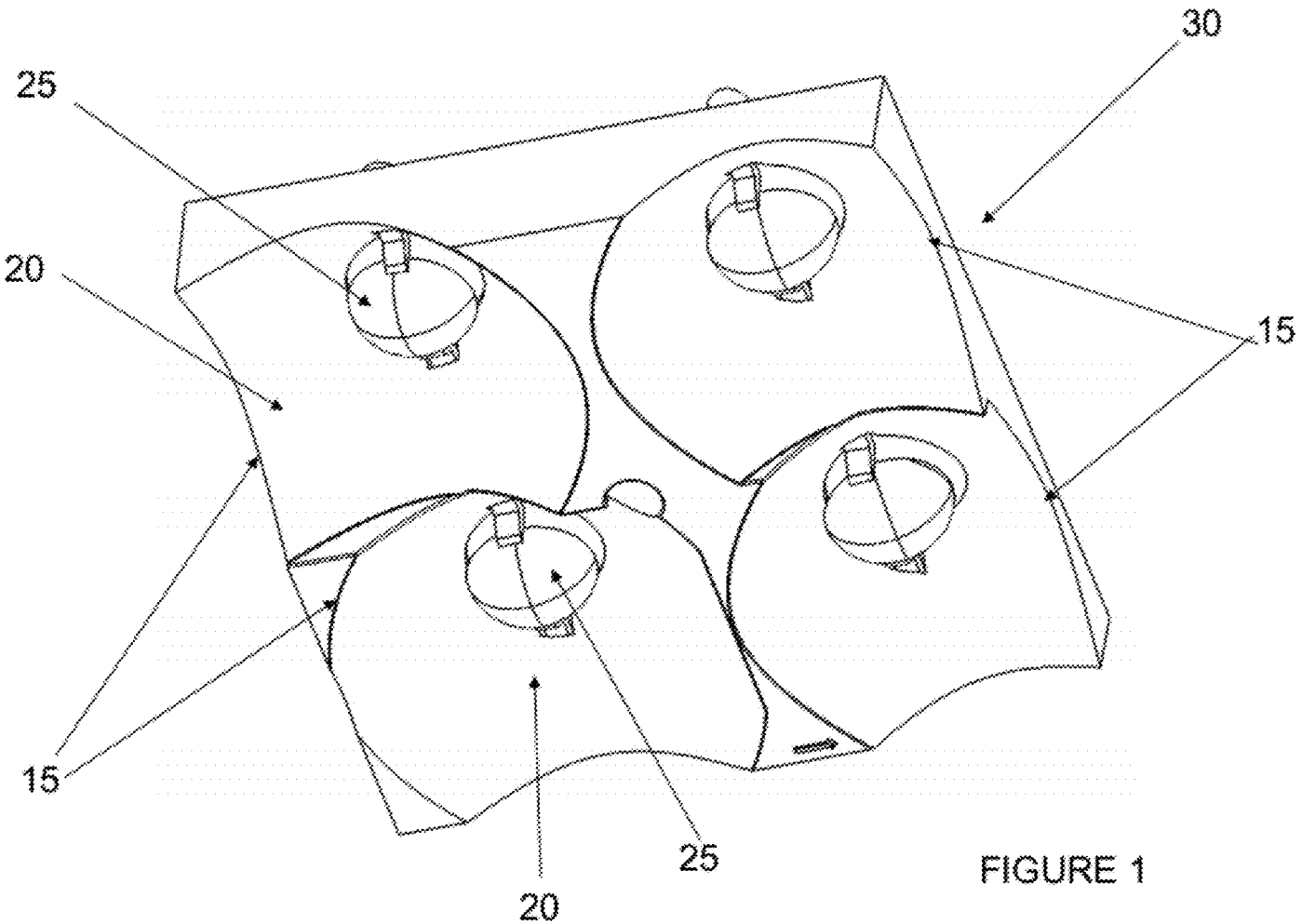
FIG. 1 is a front-side view of an exemplary module including a 2×2 array of optical elements in accordance with an embodiment of the present invention.
Figures 2A, 2B, 2C, 2D:
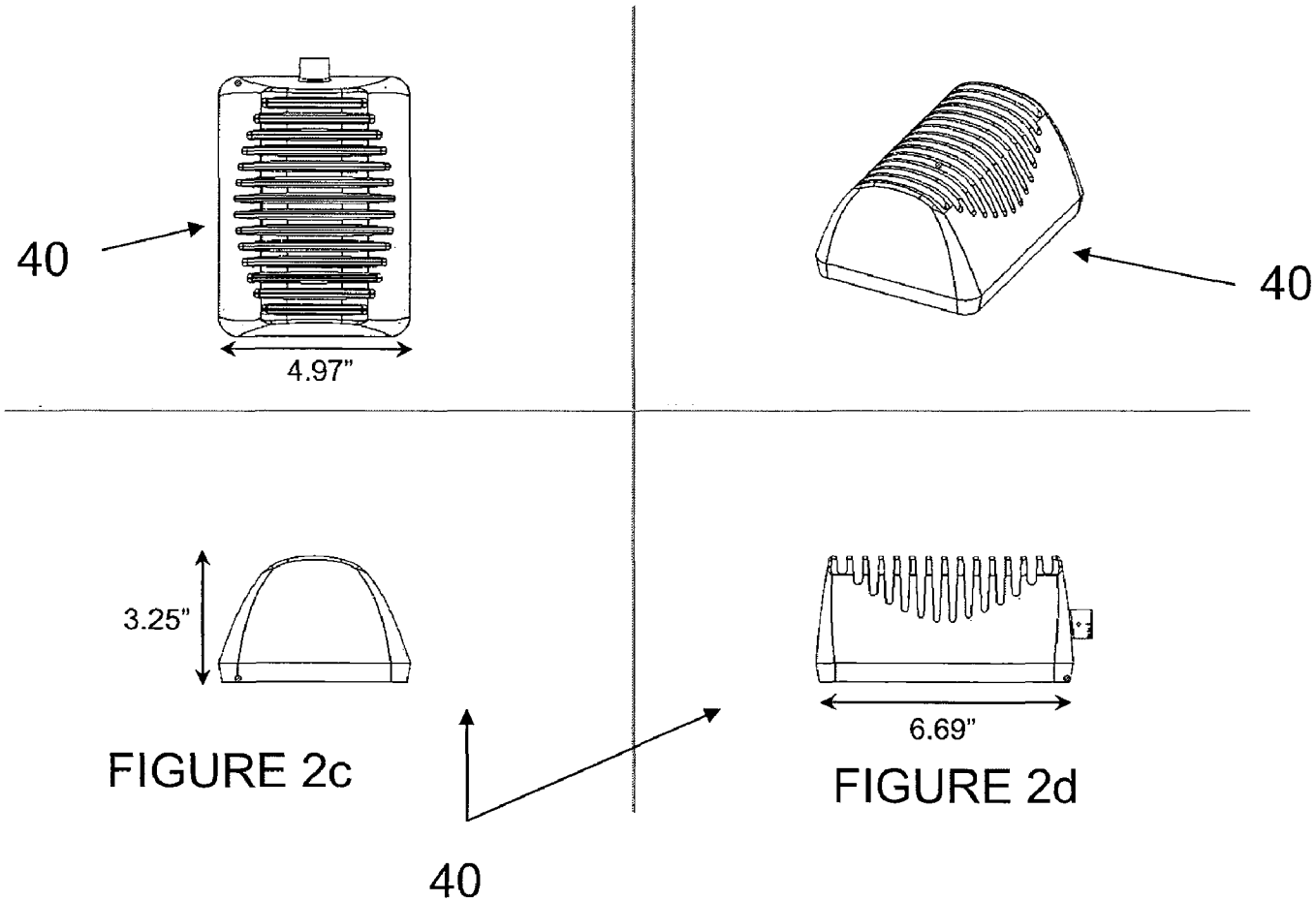
FIGS. 2*a*-2*g* provide views of an exemplary wall wash system in accordance with an embodiment of the present invention.
Figure 2E:
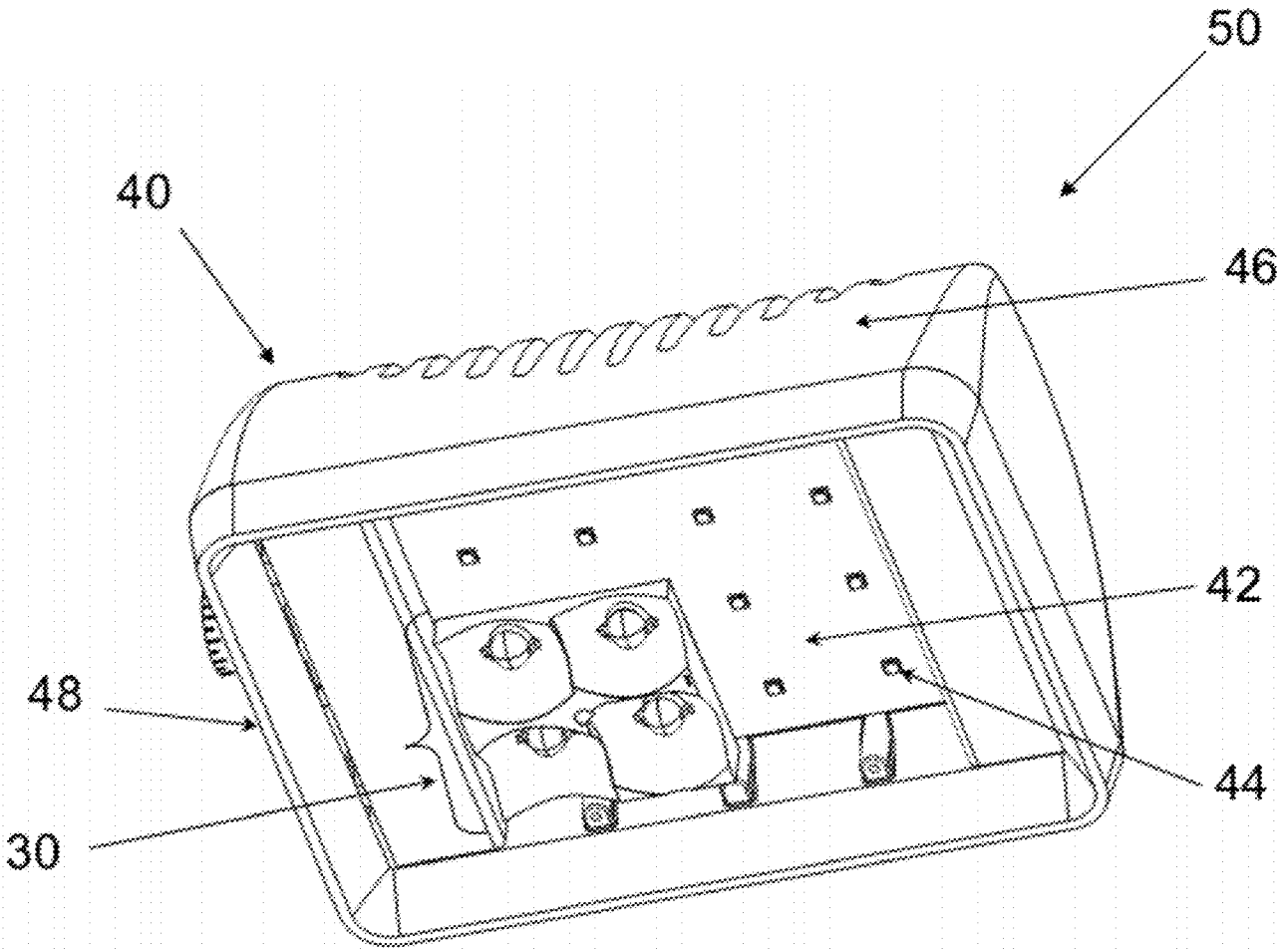
Figure 2F:
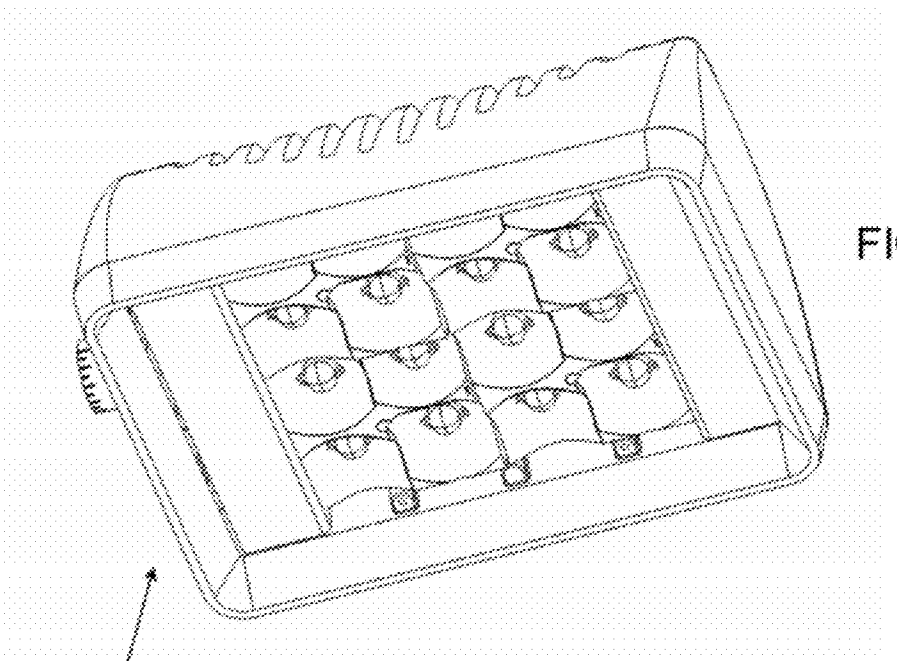
Figure 2G:
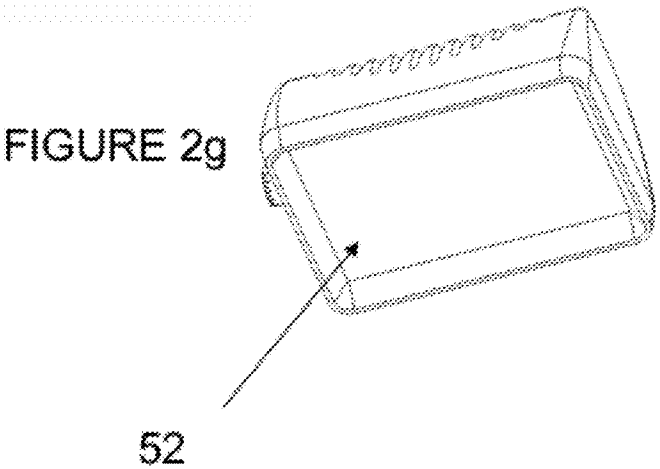

Referring to FIG. 1, an exemplary embodiment of the optical configuration of the present invention includes, at its base, some number of optical elements 15, each comprising a reflector 20 and a refractor 25. A non-limiting example of such elements can be found in U.S. Pat. No. 6,986,593 entitled "Method and apparatus for light collection, distribution and zoom," which is incorporated herein by reference in its entirety. In a particular embodiment, four of such optical elements 15 are arranged in a 2×2 array to form a module 30. Referring to FIGS. 2*a*-2*g*, multiple modules are affixed to a track system which includes a fixture 40. FIGS. 2*a*-2*d* show various top views of the fixture 40 with exemplary dimensions thereof identified, i.e., width 4.97 inches, length 6.69 inches and height 3.25 inches. These dimensions are approximate. One skilled in the art recognizes that these dimensions are merely exemplary. FIG. 2*e*-2*g* show further details of an exemplary fixture 40 including with a printed circuit board 42 and LEDs 44 as well as heat sink 46 and trim 48 (also shown in FIGS. 2*a*-2*d*). The use of LEDs allows for reduced wattage consumption, extended lifetime and reduced packaging. FIG. 2*e*-2*d* illustrates a combination of the fixture 40 and modules 30 to form an optical wall wash system 50. More particularly, four modules 30 (16 optical elements 15) are combined with the fixture 40 as shown in FIG. 2*f*. An optional configuration also includes a cover lens 52 which operates as a diffuser and sits inside the trim 48 over the modules 30 (not shown) as shown in FIG. 2*g*.

There is a 1:1 correspondence between elements 15 and LEDs, with the LEDs being positioned behind the refractors 25 when the modules 30 are affixed to the fixture 40. A first portion, e.g., a center portion, of the LEDs light distribution passes through and is refracted by the refractor, passes through the diffuser lens and then to the wall. Similarly, a second, azimuthal portion of the LEDs light distribution is reflected off of the reflector, through the diffuser lens and onto the wall. The LEDs are packaged in a conventional package, which is generally comprised of a substrate in which the light emitting junction is encapsulated in a transparent epoxy or plastic housing formed to provide a hemispherical front dome or lens over the light emitting junction or chip. Many different types and shapes of packages could be employed by an LED manufacturer and all types and shapes are included within the scope of the invention.

Figure 3:
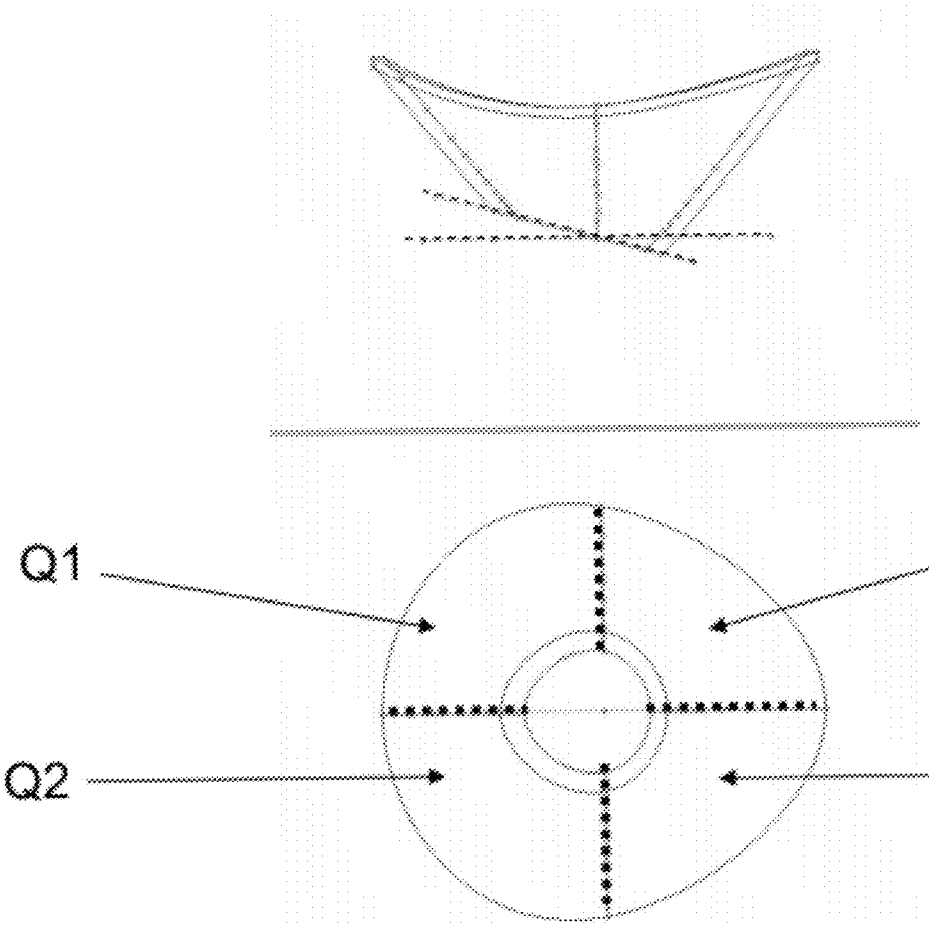
FIG. 3 represents exemplary reflector form using four sketches in accordance with an embodiment of the present invention.
Figure 7:
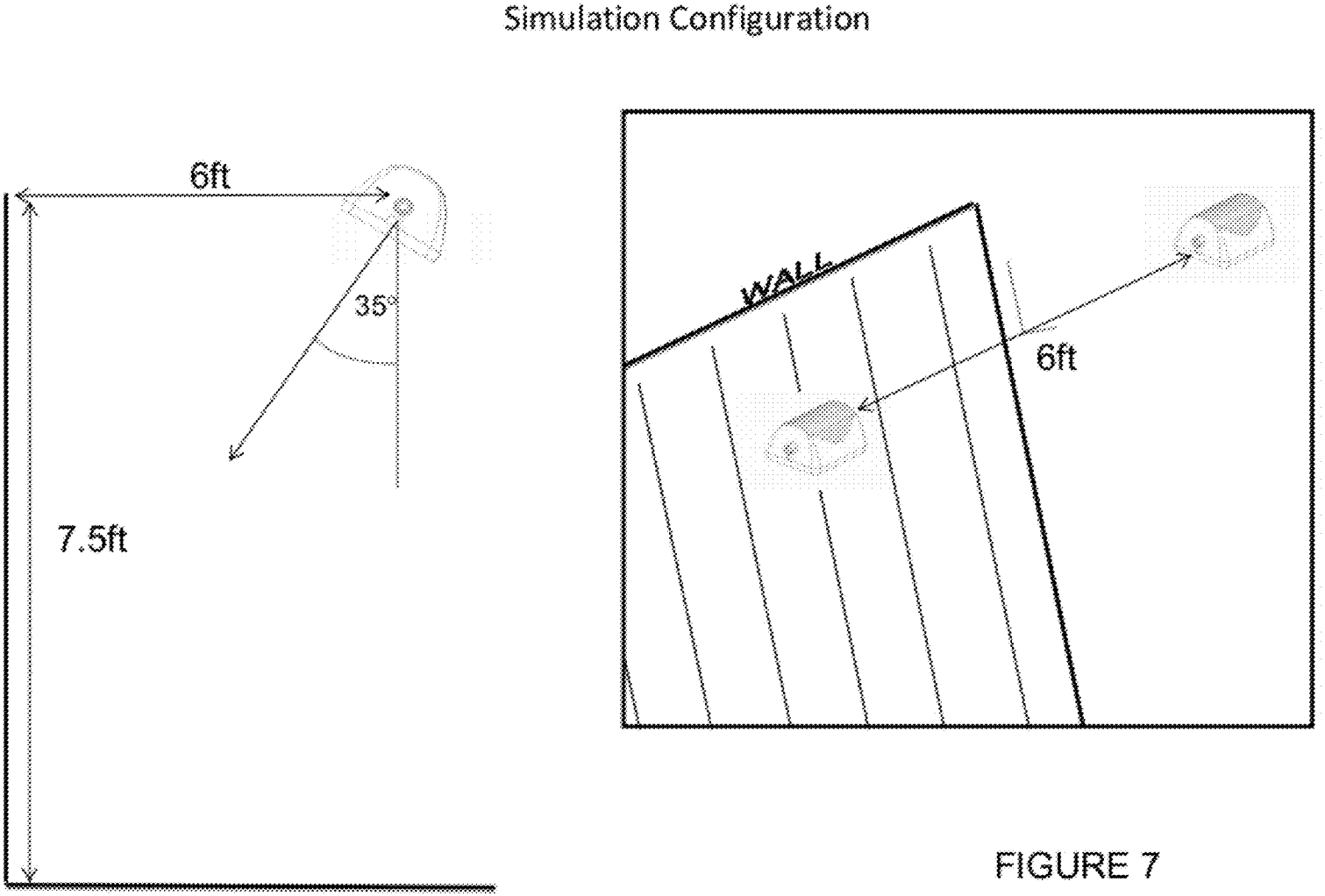
FIG. 7 is a representation showing an exemplary spacing configuration with respect to an exemplary wall wash system and common room dimensions in accordance with an embodiment of the present invention.

In a particular exemplary embodiment, there are multiple optical and mechanical variables of the optical wall wash system 50 that contribute to a uniform wall wash given a known fixture rotation with respect to nadir, e.g., 35 degrees as illustrated, with a range of 20 to 45 degrees being within the scope of the embodiments; the distance of the fixture from the wall, e.g., 6 feet; the height of the wall, e.g., 7.5 feet; and the height of the fixture, e.g., 3 to 4 inches (as shown in FIG. 7 and FIG. 2*c*). Further, in preferred configurations, there are two wall wash systems 50 spaced apart at predetermined distances of approximately 4, 5 or 6 feet. Again, these dimensions are representative. More particularly, referring to FIG. 3*a*, a first variable is the reflector configuration which is formed using four separate quadrant sketches (Q1, Q2, Q3, Q4) with the final shape generated by a lofting function with a baseline as the guide curve. Accordingly, the resulting reflector shape is not symmetrical, but instead is designed to accommodate the variable distribution of the light energy emitted from the LED.

Figure 8B:
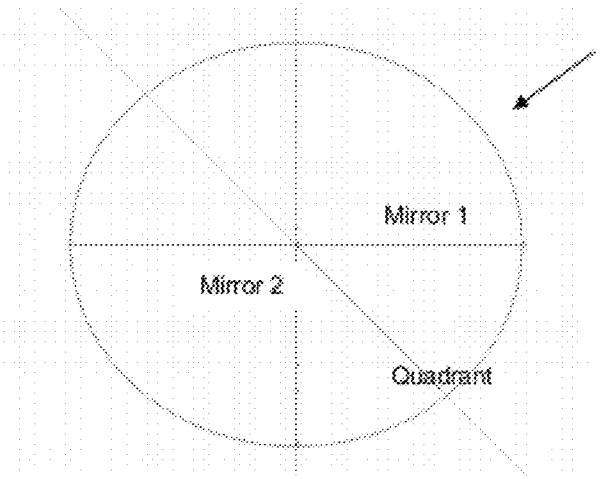
FIG. 8*a*-8*b* represent exemplary refractor formation sketches in accordance with an embodiment of the present invention.
Figure 8A:
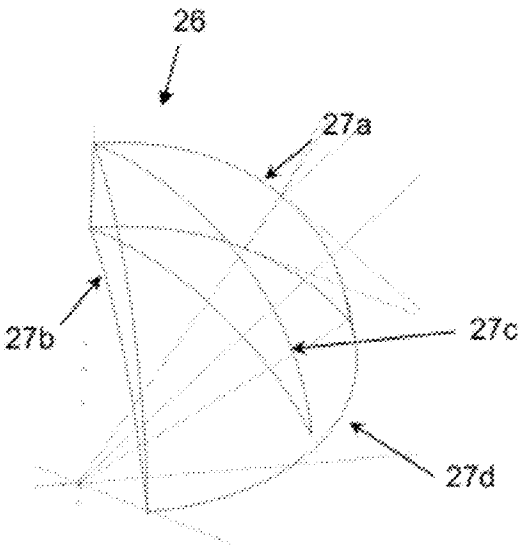

Similarly, the refractor shape is also a loft, but it is accomplished using three sketches and it is lofted slightly differently from the reflector shape. Referring to FIGS. 8*a* and 8*b*, refractor 25 is made in three steps. Step one is to generate a quadrant 26 of the lens using a plurality of sketches. This is done by creating a vertical sketch in the short axis (direction along the width of the lens) 27*a*, a second vertical sketch in the long axis (direction along the length of the lens) 27*b*, a third vertical sketch on a diagonal plane that bisects the short and long axes' vertical planes (45° from either axis) 27*c*, and a horizontal sketch at the base of all three vertical sketches, that acts as the lofting guide curve 27*d*. Step two is to mirror the solid generated from these sketches along the long axis plane (Mirror 1). Step three is to mirror the resultant solid of the first mirror function along the short axis plane to complete the lens (Mirror 2). All three solids are merged into one solid. This solid is copied and oriented corresponding to the cell rotation in a 2×2 arrangement (discussed below). The bracket and leg attachment geometry are added to the refractor lenses to complete the 2×2 lens module (discussed below).

Next, each optical element 15 comprised of individual reflector and refractor together is oriented in a predetermined manner with respect to its individual LED which is part of the underlying fixture 40. In the particular exemplary embodiment, the four optical elements are rotated 15, 10, 5 and −5 degrees from their respective LEDs. These orientations of the optical elements 15 are fixed within the modules 30. The modules 30 are then affixed to the fixture 40. The fixture 40 is itself rotated 35 degrees from nadir towards the wall.

Figure 4A:
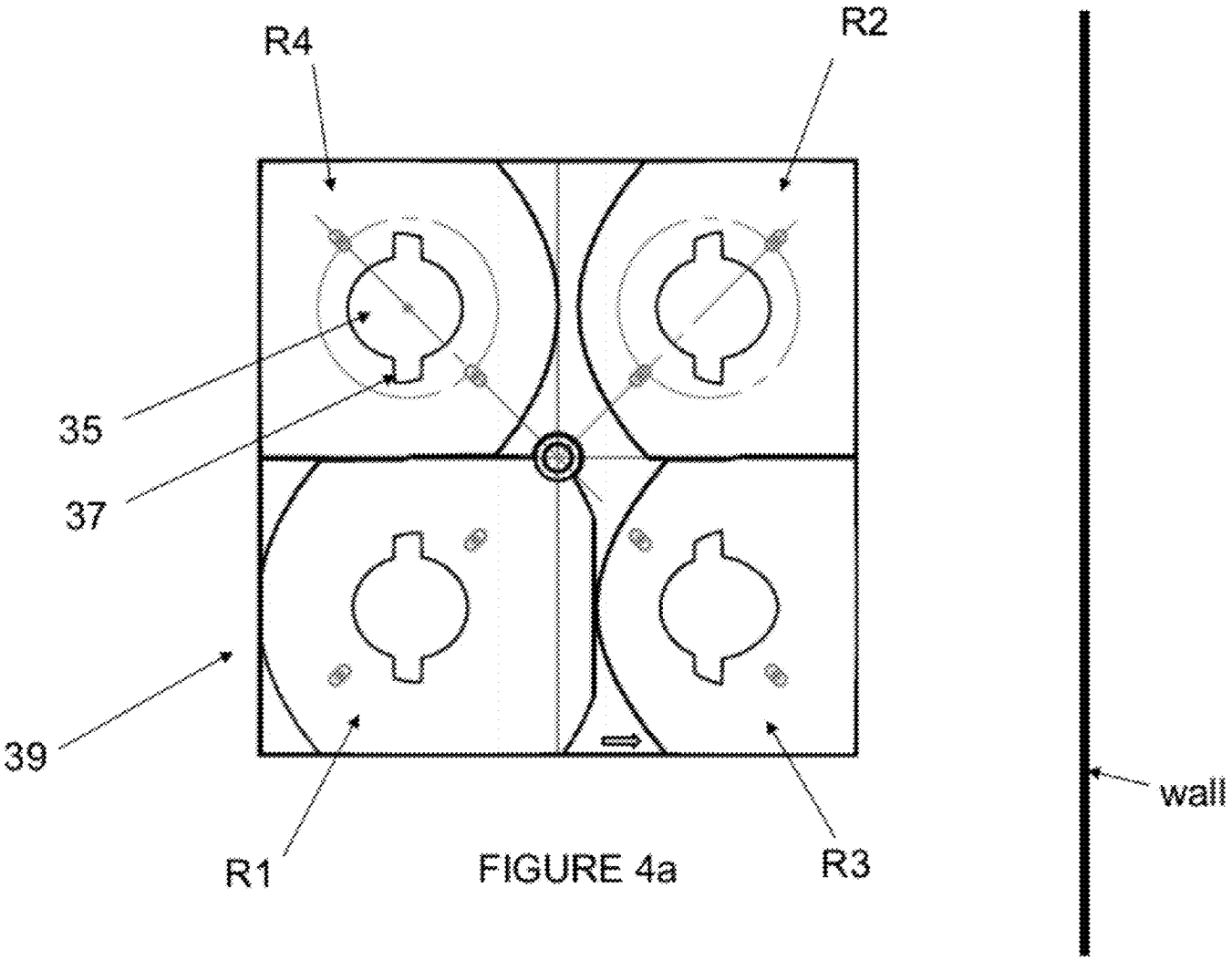
FIGS. 4*a*-4*c* are various views of a reflector only portion of an exemplary module in accordance with an embodiment of the present invention.
Figure 4B:
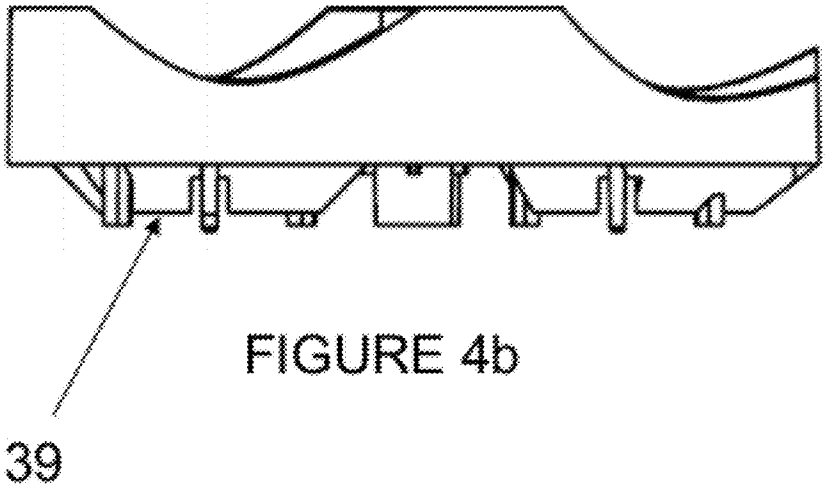
Figure 4C:
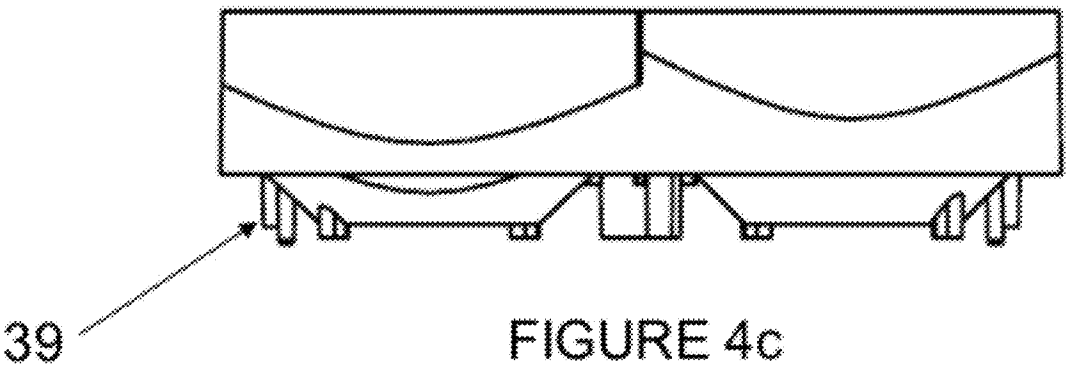

FIGS. 4*a*-4*c* show various views of the module 30 with just the reflectors (no refractors) shown, referenced herein as 39. This reflector component 39 is formed using polycarbonate (PC) that is aluminized FIG. 4*a* is a top view which highlights the rotations of the reflectors. More particularly, a first reflector R1 is rotated 5 degrees, a second reflector R2 is rotated 10 degrees, a third reflector R3 is rotated 15 degrees and fourth reflector R4 is rotated −5 degrees. FIG. 4*a* also shows openings 35 with notches 37 for receiving the refractors therein as described below. FIGS. 4*b* and 4*c* represent side views of the module 30 with just reflectors and illustrates the rotation of the reflectors. FIGS. 4*b* and 4*c* also illustrate the underlying backing for affixing the modules 30 to the fixture 40 (not shown).

Figure 5A:
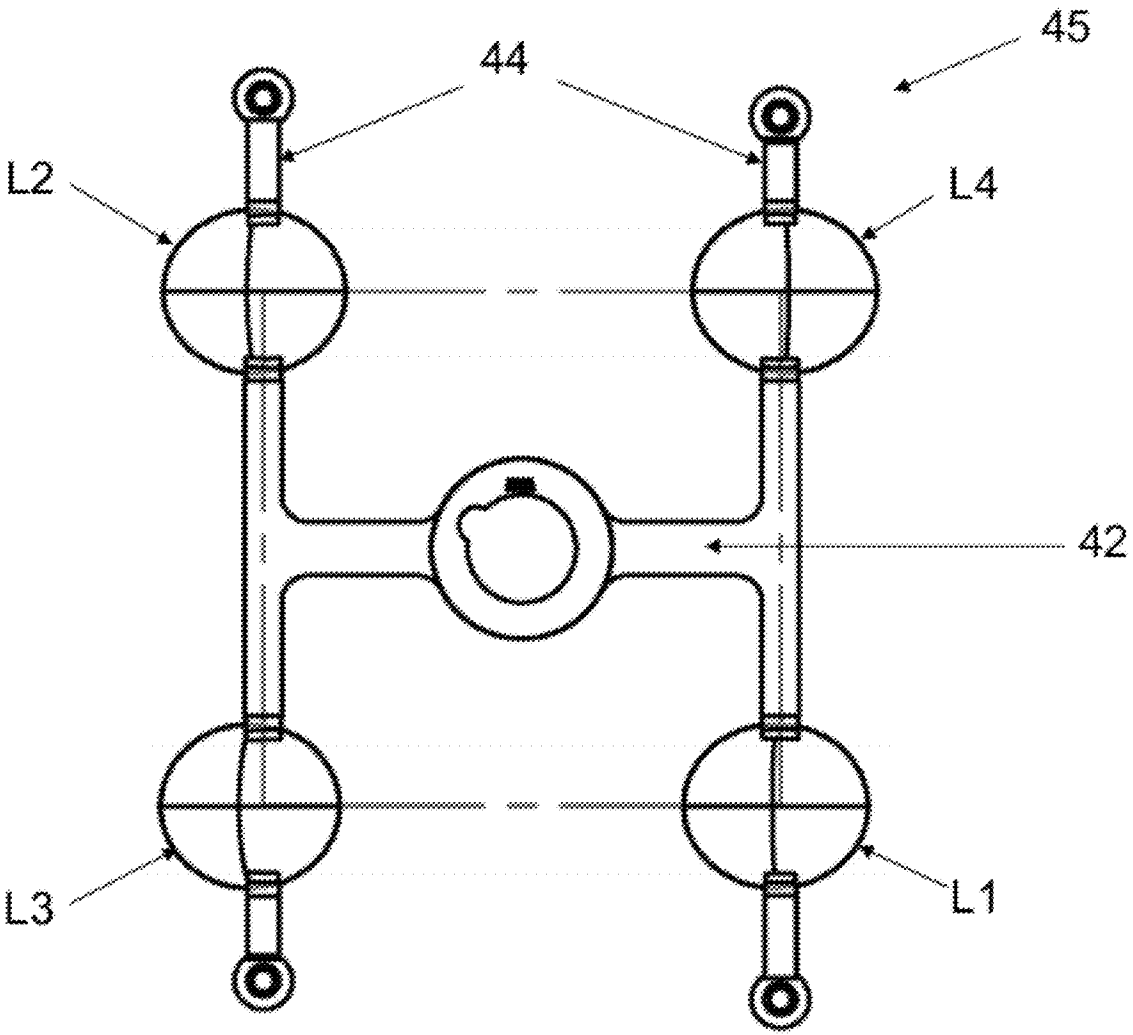
FIGS. 5*a*-5*c* are various views of a refractor only portion of an exemplary module in accordance with an embodiment of the present invention.
Figure 5B:
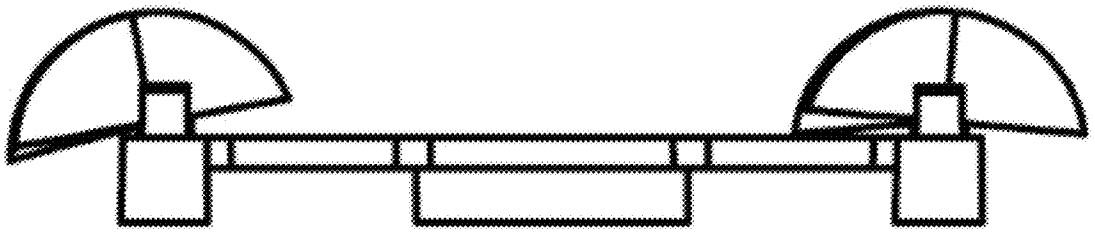
Figure 5C:
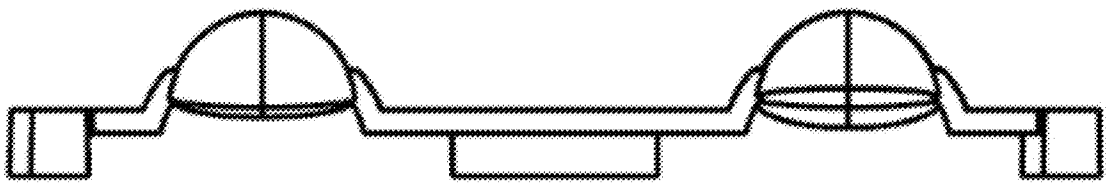

FIGS. 5*a*-5*c* show various views of the module 30 with just the refractors (no reflectors) shown. FIG. 5*a* is a top view which highlights the rotations of the refractors. More particularly, a first refractor L1 is rotated 5 degrees, a second refractor L2 is rotated 10 degrees, a third refractor L3 is rotated 15 degrees and fourth refractor L4 is rotated −5 degrees. FIG. 5*a* shows sections 42 and 44 attached to the refractors L1 through L4 which are all molded as a single piece 45 using acrylic (PMMA) or polycarbonate (PC) which is secured to the reflector configuration shown in FIGS. 4*a*-4*c*. FIGS. 5*b* and 5*c* represent side views of the module 30 with just refractors and illustrate the rotation of the refractors.

Figure 6:
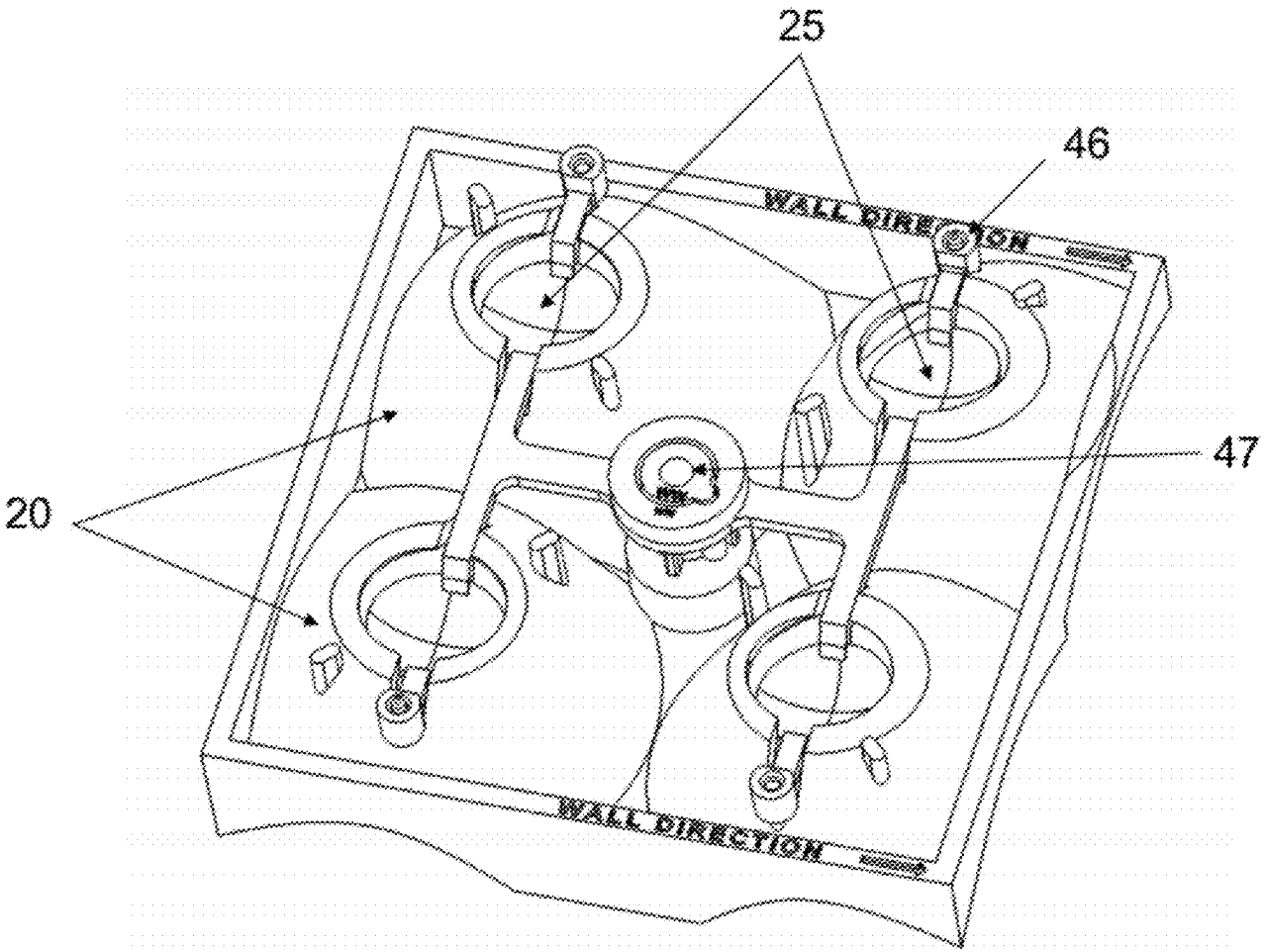
FIG. 6 is a back-side view of an exemplary module including a 2×2 array of optical elements in accordance with an embodiment of the present invention.

Referring to FIG. 6, the back side geometry of a module 30 is shown wherein the reflectors 20 and refractors 25 are connected and fixed in orientation by attaching the pieces 39 and 45 at pin and slot point 46. The module 30 may then be affixed to a fixture 40 (not shown) via slot 47.

As shown and described above, the wall wash system 50 is modular in various respects. Initially, the 2×2 array of a module 30 represents a first level of modularity. Next, the fixture 40 including LEDs represents a second level of modularity. This second level of modularity is particularly useful in that the configuration of the modules 30 can be changed to achieve different objectives, e.g., wall wash and flood, without the need to change the fixture and LED light sources in any respect. Accordingly, in an alternative embodiment, the elements and modules are formed so as to provide a flood light pattern and can be interchanged with the modules 30 according to user need. More particularly, the reflector configuration of the elements is simplified to a single sketch and revolved about the optical axis to achieve, for example, 15, 25, 40 degree floods. The modularity of the invention described herein facilitates fairly simple optics interchangeability to achieve various lighting configurations.

The reflector and refractor combination forming the elements 15 adds an additional significant level of controllable variability, wherein sketch and lofting functions can be varied in order to achieve various light distributions. And, as discussed above, the angles of the individual elements 15 may be varied within the fixed module 30, again, to achieve desired light distribution. One skilled in the art recognizes that various configurations not specifically described herein are well within the scope of the invention which achieves variable light distributions using LED light sources in combination with interchangeable optics including reflector and refractor combination elements.

A method for forming a module for use in a wall wash system includes generating 2×2 reflector and 2×2 refractor arrays using, for example, the CAD (computer-aided design) software running on a processor. The next step is to assemble these optical components along with other mechanical components (heat sink, trim rings, a diffused flat cover lens, LED board, etc.) to complete the fixture.

To evaluate the performance of the fixture, these components are imported into the optical simulation software running on a processor. The first action in the simulation software is to define the LED model (light source), determine the number of LEDs, e.g. 16, and array the LEDs in the desired arrangement (e.g., 4×4 array) as inputs to the optical simulation software. Next, the optical and mechanical components are imported into the simulation software from the CAD software, where they are located and oriented correctly relative to the optical axis, the origin, and the LEDs' chip locations. The optical components are arrayed into the 4×4 LED array, i.e. four 2×2 modules to cover all 16 LEDs.

Next, a wall plane and floor plane is defined in the simulation, i.e. the size and location of the planes from the fixture. The fixture is then rotated towards the wall plane at an angle relative to nadir (range of 20° to 45°). Optical and material properties are then assigned to each component of the fixture as inputs to the optical simulation software. Also, the number of rays to be emitted (typically 20 million rays) from the LEDs is defined and input to the optical simulation software. Once all these steps are done, the simulation is executed on the processor. Upon completion, the optical distribution on the wall is evaluated. If it is unsatisfactory the process is repeated, starting from the CAD software stage, until the desire distribution is met.

The invention claimed is:

1. An optical wall wash system comprising:

at least one module comprised of a 2 by 2 array of fixed elements, each element including a reflector and a refractor;

a wall wash fixture, including light emitting diodes (LEDs) affixed thereto, for securing the at least one module, wherein there is a 1:1 correspondence between elements and LEDs and at least a portion of the wall wash fixture is rotated a first angular amount from nadir and towards a wall; and further wherein each of the elements within the at least one module is oriented a different angular amount, separate from the first angular amount that the wall wash fixture is rotated, in relation to its underlying LED from each other element within the at least one module.

2. The optical wall wash system of claim 1, further comprising four modules forming a 16×16 array of elements.

3. The optical wall wash system of claim 1, wherein the different angular amounts are 15 degrees, 10 degrees, 5 degrees and −5 degrees.

4. The optical wall wash system of claim 1, wherein the LEDs are positioned such that a first portion of light emitted from each LED passes through the refractor and a second portion of the light emitted from each LED is reflected by the reflector.

5. The optical wall wash system of claim 1, wherein the 2×2 array of elements includes a first molded component that includes four refractors and a second molded component that includes four reflectors.

6. The optical wall wash system of claim 5, wherein the first molded component is formed of PMMA or PC.

7. The optical wall wash system of claim 5, wherein the second molded component is formed of at least PC and aluminized.

8. The optical wall wash system of claim 5, wherein the first angular amount is selected from the range 20 to 45 degrees.

9. The optical wall wash system of claim 1, wherein the wall wash fixture further includes a heat sink.

10. An optical wall wash system comprising:

at least one module comprised of an array of more than 2 fixed elements, each element including a reflector and a refractor;

a wall wash fixture, including light emitting diodes (LEDs) affixed thereto, for securing the at least one module, wherein there is a 1:1 correspondence between elements and LEDs and at least a portion of the wall wash fixture is rotated a first angular amount from nadir and towards a wall; and further wherein each of the elements within the at least one module is oriented a different angular amount, separate from the first angular amount that the wall wash fixture is rotated, in relation to its underlying LED from each other element within the at least one module.

11. The optical wall wash system of claim 10, further comprising four modules forming a 16×16 array of elements.

12. The optical wall wash system of claim 10, wherein the different angular amounts comprise at least three of 15 degrees, 10 degrees, 5 degrees and −5 degrees.

13. The optical wall wash system of claim 10, wherein the LEDs are positioned such that a first portion of light emitted from each LED passes through the refractor and a second portion of the light emitted from each LED is reflected by the reflector.

14. The optical wall wash system of claim 10, wherein the array includes a first molded component that includes a plurality of the refractors and a second molded component that includes a plurality of the reflectors.

15. The optical wall wash system of claim 14, wherein the first molded component is formed of PMMA or PC.

16. The optical wall wash system of claim 14, wherein the second molded component is formed of at least PC and aluminized.

17. The optical wall wash system of claim 14, wherein the first angular amount is selected from the range 20 to 45 degrees.

18. The optical wall wash system of claim 10, wherein the wall wash fixture further includes a heat sink.

* * * * *